US005131172A

United States Patent [19]

Stevenson et al.

[11] Patent Number: 5,131,172

[45] Date of Patent: Jul. 21, 1992

[54] CONTACTOR FOR GRANULAR MATERIALS

[75] Inventors: William L. Stevenson, Roseville; George E. Anderson, Champlin, both of Minn.

[73] Assignee: Crown Iron Works Company, Roseville, Minn.

[21] Appl. No.: 555,080

[22] Filed: Jul. 18, 1990

[51] Int. Cl.[5] ..... F26B 19/00; F26B 25/18

[52] U.S. Cl. ..... 34/231; 34/57 A; 34/218

[58] Field of Search ..... 34/57 A, 57 D, 181, 34/218, 217, 231

[56] References Cited

U.S. PATENT DOCUMENTS 3,214,844 11/1965 Oates et al. ..... 34/10

4,419,834 12/1983 Scott ..... 34/57 A

*Primary Examiner*—Edward G. Favors

*Attorney, Agent, or Firm*—Lawrence M. Nawrocki

[57] ABSTRACT

A granular material treating device. Included are a housing having an input end and an output end and a porous conveyor belt disposed within the housing so that a generally horizontally-disposed run of the belt extends between the input and the output ends of the housing. The belt is configured to be driven to convey granular material, positioned to a desired depth on the belt, from the input end to the output end of the housing. The device also includes a nozzle disposed beneath the run of the belt extending from the input end to the output end of the housing. The nozzle is oriented to blow a gas, at a pressure greater than ambient gas in the housing, upwardly through the belt run. A spout within the granular material is, thereby, created to effect stirring. Finally, the device includes a stave which extends downwardly into the granular material as it is conveyed along the belt. The stave is positioned forwardly of a location at which the spout it created to generate a void at the approximate location of the spout.

6 Claims, 3 Drawing Sheets

CONTACTOR FOR GRANULAR MATERIALS

TECHNICAL FIELD

The present invention deals broadly with the field of processing of granular materials. More narrowly, however, the invention deals with contacting (i.e., with gaseous jets) granular materials, such as grains, passing on a moving conveyor belt. When contacting is effected with hot air, heating of the grain is accomplished without employing a fluidized bed. The invention focuses upon apparatus for facilitating more efficient heating as a result of mixing.

BACKGROUND OF THE INVENTION

Various types of dryers and coolers for granular materials are known in the prior art. In one type, known as a fluidized bed, a cushion of air or hot gas is blown through a porous bottom floor plate of a container. As a result, the granular material in the container is floated to effect drying, heating, quenching, calcination, or some other function.

The fluidization process, however, has a number of drawbacks. For example, an extremely high volume of air is necessary in order to produce even fluidization. A high added pressure drop across the plate at the bottom of the container through which the air is blown is a consequence of using sufficient air in attempting to ensure good distribution. Non-fluidized pockets may, in any case, result, and consequent non-conveyed pockets and product damage, or even fire, can resultantly occur.

Design problems are also inherent in fluidized bed drying. The distributor floor plate design involves a balance between an excess of orifices and corresponding covering bubble caps (which would introduce inaccuracy of air distribution and prove very expensive), on the one hand, and an insufficient number of such orifices and cover caps (which would result in too great a pressure drop across the slab), on the other.

Additionally, fluidized bed drying involves significant time and expense investment in maintenance. Periodic cleaning of the floor plate orifices and cover caps must be performed, as well as periodic removal of scrap iron or wood. Apparatus must be provided to convey away stones from the bottom of the bed.

In a fluidized bed also, only some material will be fluidized and conveyed away from the bed. Only material light in weight, such as the grain, will be fluidized and conveyed up and over a final baffle that holds the fluid bed depth.

In an attempt to overcome these deficiencies of the fluidized bed, other apparatus have been developed. B.N.W. Industries of Mentone, Ind. has developed a product known as the BELT-O-MATIC. In this device, wet grain is fed onto an end of a continuous conveyor belt. The belt is porous and is disposed for movement of an upper run thereof in a direction so as to convey the inputted wet grain through a housing of the apparatus. The upper run of the belt travels over a multiplicity of rollers which support the weight of the belt and grain. The belt porosity is sufficient to permit the passage of heated air upwardly therethrough without significant restriction. Heated air is provided by a unit within the housing below the conveyor belt.

Such a device conveys granular material to be dried much more efficiently than does a fluidized bed. The costs incident to fluidization are much greater because of the increased power necessary to provide the conveying function in a fluidized bed.

Additionally, a moving belt serves to convey all materials out of the housing, unlike a fluidized bed wherein some materials will be caught by the final baffle. A belt conveyor requires little if any cleaning. In fact, the pores in the belt will be purged of occluding material and dust particles as the belt flexes over special cleaning sprockets.

While the BELT-O-MATIC is an improvement in some respects over fluidized bed drying, never-the-less, there are problems existent with this device. In a dryer/cooler device, it is important that a maximum amount of the granular material be worked. Because of the depth at which the layer of granular material is maintained, it frequently happens that even heating is not effected. This is so, because, once the grain is inputted to the device, it is not agitated in any manner.

It is to these deficiencies and dictates of the prior art that the present invention is directed. The present invention is an improved granular material contacting apparatus which more efficiently functions to effect processing of a granular material.

SUMMARY OF THE INVENTION

The present invention is a device for contacting granular materials with a gas, such as hot air. The device includes a housing through which the granular materials are conveyed. A run of a porous conveyor belt extends from an input end of the housing to an output end, and rotation of the continuous belt effects conveyance of the granular material, positioned at a desired depth on the belt, from the input end to the output end of the housing. At least one nozzle for discharging the gas, such as heated air, is positioned beneath the belt run on which the granular material passes through the housing. The nozzle is oriented to blow the gas, at a pressure greater than ambient gas in the housing, upwardly through the belt run. As a result, gas discharged from the nozzle effects both contacting of the granular material and mixing thereof, in view of the fact that passage of the gas discharged from the nozzle through the granular material creates a spout of circulating material.

In a preferred dryer application embodiment of the invention, a plurality of such nozzles are provided. It is intended that a manifold, serving as a source of heated air at a pressure slightly above ambient air in the housing, provides such heated air to a plurality of feed pipes. The feed pipes are spaced axially within the housing along an axis parallel to the direction in which the belt run conveys the granular material, and the pipes are positioned beneath the belt run. In this embodiment, each feed pipe is provided with multiple nozzles directed to discharge the heated, pressurized air upwardly through the porous belt run. By so providing such a nozzle array, heating and mixing of the granular material substantially along the full length of the belt is accomplished.

The preferred embodiment also envisions provision of a stave which works in combination with each nozzle. A stave, corresponding to each nozzle, is provided so as to extend downwardly into the granular material as it is conveyed through the housing. The stave is positioned slightly forwardly of the location at which a spout is created. Consequently, the stave generates a void at the approximate location of its corresponding spout. This void allows the spouting and mixing to occur with less air pressure at the jet. More reliable mixing is, thereby, achieved with reduced fan power.

The present invention is thus an improved apparatus for processing granular materials. More specific features and advantages obtained in view of those features will become apparent through the DETAILED DESCRIPTION OF THE INVENTION, appended claims, and accompanying drawing figures.

DETAILED DESCRIPTION OF THE INVENTION

Figure 1:
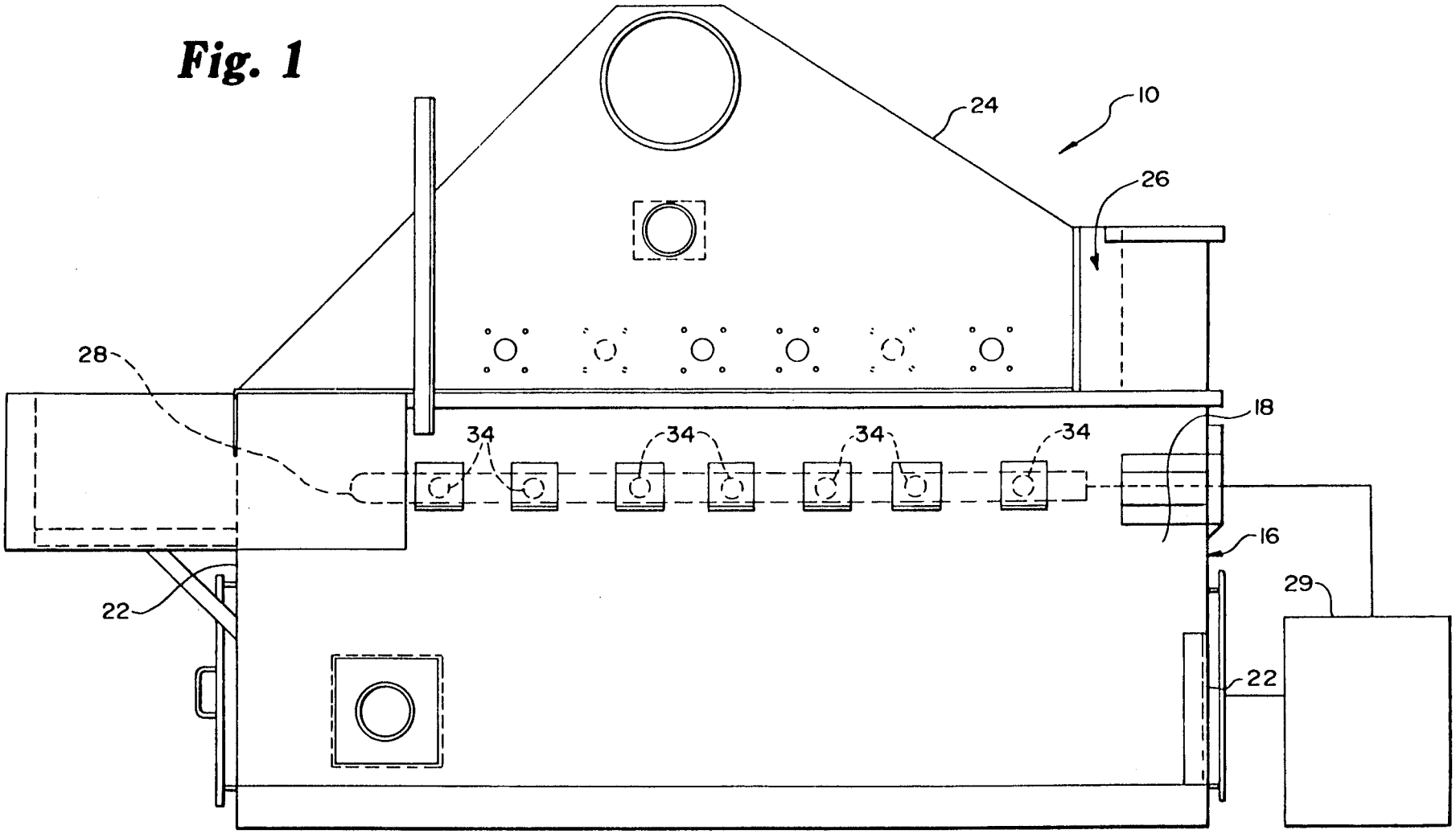
FIG. 1 is a side elevational view of the present invention, some portions being illustrated in phantom.
Figure 2:
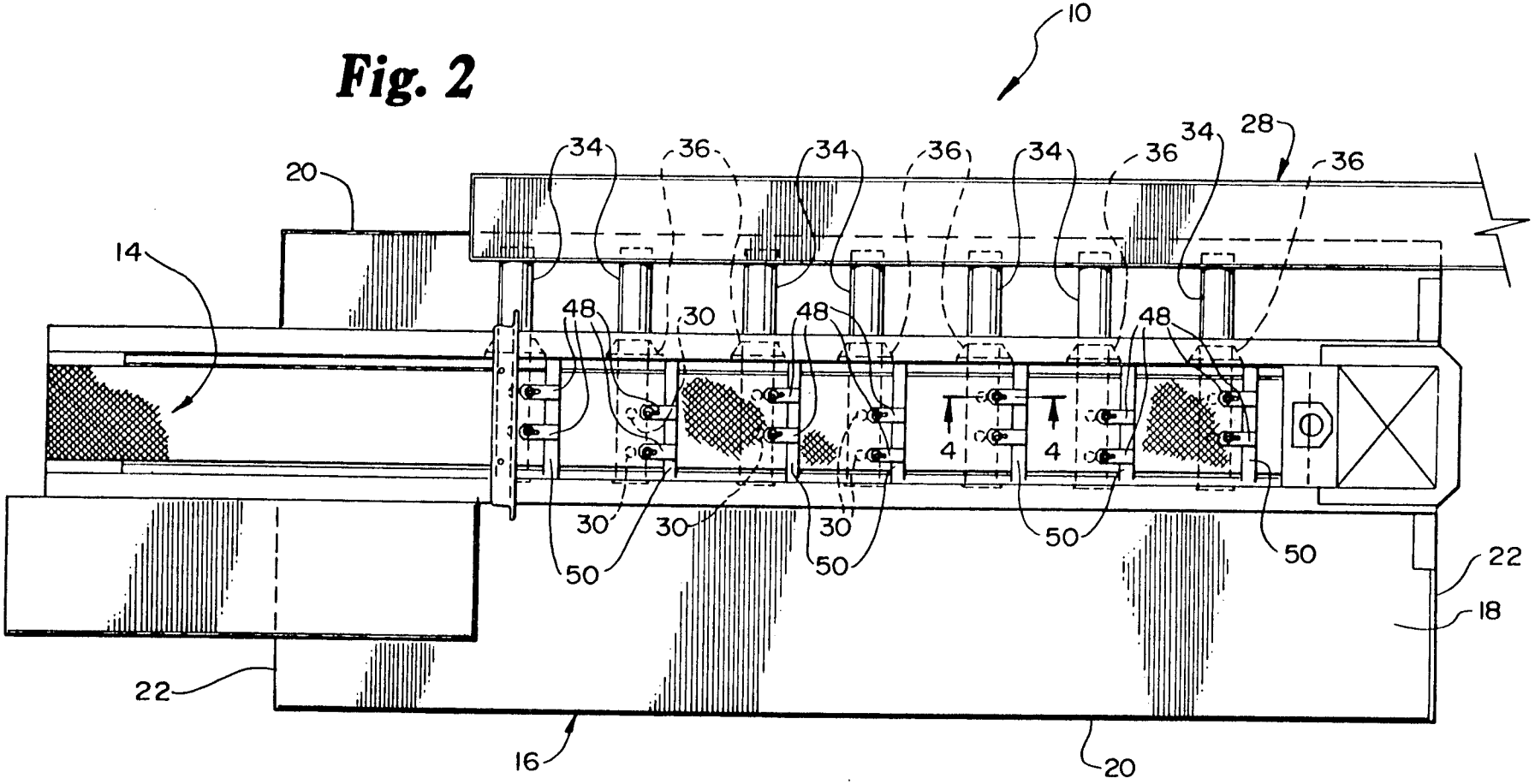
FIG. 2 is a top plan view of the device of FIG. 1.

Referring now to the drawings wherein like reference numerals denote like elements throughout the several views, FIGS. 1 and 2 illustrate a device 10 in accordance with the present invention. The application of the particular embodiment illustrated is one wherein heated air is employed as a gas to contact a grain 12 passing on a conveyor 14 to effect heating and drying of the grain 12. It will be understood, however, that the invention specifically envisions other applications wherein a granular material is contacted by a gas to effect a particular function. For example, the gas employed could be carbon dioxide, wherein contacting of the particulate material by the carbon dioxide is for the purpose of snuffing out fire prior to entry of the granular material into storage or solvent systems. If fire were not snuffed out, combustion could occur.

Additionally, the gas could be a heated solvent vapor such as hexane. Contacting of the granular material by the heated hexane could be accomplished to remove liquid hexane from the granular material by evaporation.

Contacting could also be by a gas to effect other functions. Illustrative of these functions are applications of coatings, biologically active agents, oxidation retarding chemicals, etc.

As can be seen, therefore, numerous potential applications exist for the present invention. While, as pointed out, many applications are available, the description herein will be with reference to a grain drying device 10 wherein the grain 12 is conveyed through a housing 16 on a continuous, porous conveyor belt 14. The housing 16 includes a closed plenum 18 confined within opposite side walls 20 and end walls 22. The plenum 18 is closed by a hood 24 placed over the housing 16.

Proximate the right end, as viewed in FIG. 1, is an input 26 through which the granular material 12 is fed onto the conveyor belt 14. The conveyor belt 14 is a continuous belt and extends about sprockets (not shown) at the input end and output end of the housing 16. The sprockets can be of a type known in the art wherein, as the belt 14 is flexed as it passes over the sprockets, build-up of particulate material in the small orifices through the belt 14 can be cleaned.

The left end of the dryer 10, as seen in FIG. 1, is an output end at which the grain 12 is recovered after it has been processed by having been heated to effect drying. Recovery can be accomplished in any appropriate manner known in the prior art.

FIG. 2, in particular, illustrates a manifold 28 mounted to one side wall 20 of the dryer housing 16. Heated air from a common source 29, which can include a heater/blower assembly, is illustrated schematically in FIG. 1. Heated air from the source 29 feeds both the interior of the plenum 18 defined within the housing 16 and this manifold 28. It is anticipated that approximately eighty percent of the heated air from the common source would be fed into the plenum 18 to serve as ambient air therewithin. Such ambient air would be free to pass through the porous conveyor belt 14, and upwardly through the grain 12, and to pass around the grain 12 as it is conveyed by the belt 14 from one end of the housing 16 to the other. The ambient air does, thereby, serve a heating and drying function. It will be understood that other percentages of heated air from the common source could be fed into the plenum 18. It is contemplated that any percentage between seventy-five percent and eighty-five percent would be acceptable, although even smaller or larger percentages might ultimately prove to be within limits.

The balance of the heated air from the common source would be pressurized and be channeled into the manifold 28 for subsequent distribution as will be described hereinafter. Pressurization can be accomplished in any manner known in the prior art, and the heated air directed to the manifold 28 would be pressurized so that it would be somewhat in excess of the pressure of ambient air in the plenum 18. It can, thereby, be directed in a stream from each of one or more nozzle apertures 30 positioned immediately beneath the upper run 32 of the porous conveyor belt 14 on which the grain 12 is being transmitted through the housing 16. Because of the increased pressure of the heated air within the manifold 28 and one or more feedpipes 34 branching off of the manifold 28, an apparent gas flow will be able to be maintained.

Figure 3:
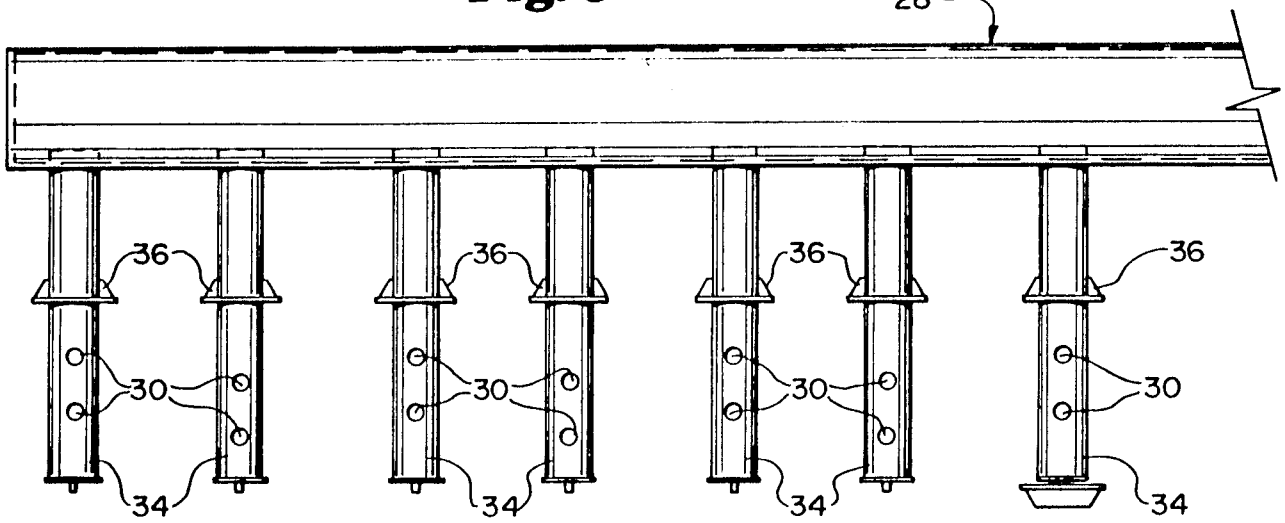
FIG. 3 is a top plan view of a subassembly of the invention.

FIG. 3 illustrates an assembly of the manifold 28 and associated plurality of feedpipes 34. FIG. 3 illustrates seven feedpipes 34. It will be understood, however, that this number is not exclusive, and more or less feedpipes 34 would be appropriate depending upon the length of the housing 16 and other factors.

Similarly, FIG. 3 illustrates feedpipes 34 each having two nozzle apertures 30 formed therein. It will be understood that more or less nozzle apertures 30 would be appropriate depending upon the width of the housing 16 and other circumstances.

FIG. 3 illustrates a right-most feedpipe 34 as having a pair of flanges 36 which engage the sides 20 of the housing 16. These flanges can function to maintain the feedpipes 34 in proper condition within the plenum 18. Additionally, and derivatively, the manifold 28 can be held in an appropriate position with respect to the housing 16. While the other feedpipes 34 are illustrated with only one flange 36, it will be understood that, typically, one would be provided at each end of a feedpipe 34.

As previously mentioned, FIG. 3 illustrates a series of feedpipes 34, each feedpipe 34 having nozzle apertures 30 formed therein. It will be noted that the location of nozzle apertures 30 in one feedpipe 34 is staggered from the location of the nozzle apertures 30 in an adjacent feedpipe 34. That is, while the two nozzle apertures 30 in one feedpipe 34 are closer to, for example, a front side wall of the housing 16, the location of the apertures 30 in an adjacent feedpipe 34 are closer to a rear side wall of the housing 16. By so staggering the nozzle apertures 30 in adjacent feedpipes 34, better distribution of blasts of pressurized heated air from the feedpipes 34 can be accomplished. More uniform drying can, thereby, be effected.

Figure 4:
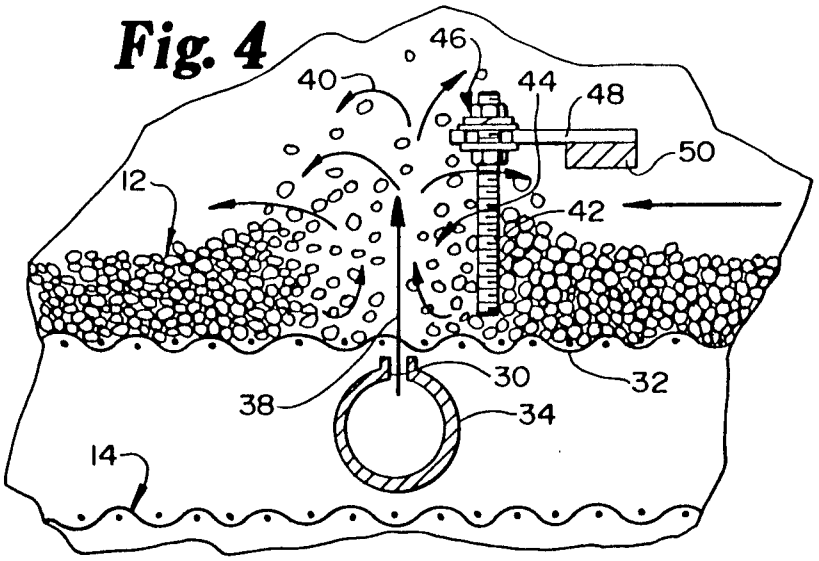
FIG. 4 is a detailed sectional elevational view taken generally along the line 4—4 in FIG. 2.

FIG. 4 illustrates a feedpipe 34 positioned between the upper and lower runs of the porous conveyor belt 14. That sectional view is taken through a nozzle aperture 30 in the feedpipe 34 and illustrates a jet of heated air (identified by arrow 38) exiting through the nozzle aperture 30. The feedpipe 34 is disposed so as to direct the jet of heated air 38 upwardly, through the upper run 32 of the porous conveyor belt 14, and through that portion of the bed of grain 12 on the belt 14 at that location.

Passage of the jet 38 of heated air from the feedpipe 34 through the bed of grain 12 will effect a spouting action (as illustrated at 40). That is, the grain 12 in the path of the jet 38 of heated air will be blown upwardly, will tend to disperse radially outwardly in a fountain fashion, and will resettle in the bed. It will be understood that this process occurs continuously as the bed of grain 12 passes along the conveyor 14. Additionally, in view of the fact that each feedpipe 34 is provided with two nozzle apertures 30 and that adjacent feedpipe nozzle apertures 30 are staggered laterally, there will be four tracks spaced laterally along the bed of grain 12 being conveyed by the conveyor belt 14. Significant coverage is, thereby, achieved.

FIG. 3 illustrates a series of feedpipes 34 having nozzle apertures 30 whose diameters are substantially equal. That is, the nozzle apertures 30 illustrated in the figures, and particularly in FIG. 3, have substantially the same area.

It is envisioned, however, that the sizes of nozzle apertures 30 in any particular feedpipe 34 could vary. If the feedpipes 34 were so structured, substantially uniform spouting could be provided. It has been found that the farther a nozzle aperture 30 is from the manifold 28, the greater will be the spouting and mixing, if the diameters of the apertures 30 are the same. Heated air entering a feedpipe 34 from the manifold 28 appears to develop a momentum and, therefore, create a greater pressure exiting nozzle apertures 30 more remote from the manifold 28. As indicated, this non-uniform spouting can be overcome by decreasing the size of nozzle apertures 30 more remote from the manifold 28.

FIGS. 2 and 4 illustrate a series of fingers 42 which extend downwardly into the bed of grain 12 as it passes through the housing 16. One finger 42 is positioned immediately forward of a location at which a jet 38 of heated air passes upwardly through the grain bed to effect spouting. By positioning a finger 42 in each of these locations, a void 44 tends to be formed immediately downflow of each finger 42. The void 44 is, basically, a diminishment of flow of the grain 12 moving through the housing 16. Because of the creation of such a void 44, each jet 38 of heated air from a feedpipe nozzle aperture 30 will more effective create spouting. As a consequence, more efficient and uniform drying will be accomplished.

As seen in FIG. 4, the fingers 42 are threaded members which are held, by appropriate nut and washer combinations (as at 46), to an arm 48. Pairs of arms 48, in turn, are mounted to a common bracket 50 which extends across the bed of grain 12 substantially transverse to the direction of movement of the grain 12 on the conveyor 14.

As previously discussed, each feedpipe nozzle aperture 30 is related to a corresponding finger 42. Spacing of fingers 42 along a particular mounting bracket 50 is, therefore, coordinated with the spacing between nozzle apertures 30 in a related feedpipe 34. Sizing, spacing, and mounting of components is adapted to effect placement of a finger 42 immediately upflow of its corresponding nozzle aperture 30 in order to create a void 44 at the location of the jet 38 of heated air as previously discussed.

The present invention is, in a sense, a hybrid between a fluidized bed and a structure such as the BELT-O-MATIC. It, thus, achieves the advantages of a fluidized bed without realizing the disadvantages similarly, it realizes the benefit of a conveyor dryer such as the BELT-O-MATIC without being limited by its shortcomings.

Numerous characteristics and advantages of the invention covered by this document have been set forth in the foregoing description. It will be understood, however, that this disclosure is, in many respects, only illustrative. Changes may be made in details, particularly in matters of size, shape, and arrangement of parts, without exceeding the scope of the invention. The invention's scope is, of course, defined in the language in which the appended claims are expressed.

What is claimed is:

1. Apparatus for contacting granular material with a gas, comprising:

(a) a housing having an input end and an output end;

(b) a continuous, porous conveyor belt within said housing, said belt having a generally horizontally disposed run extending between said input and said output ends, and being configured to be driven to convey granular material, at a desired depth thereon, from said input end to said output end;

(c) a nozzle disposed beneath said belt run and oriented to blow the gas, at a pressure greater than ambient gas in said housing, upwardly through said belt run to create a spout within the granular material to effect stirring; and (d) a stave extending downwardly into the granular material as it is conveyed through said housing, said stave being positioned forwardly of a location at which the spout is created to generate a void at the approximate location of the spout.

2. Apparatus for contacting granular material with a gas, comprising:

(a) a housing having an input end and an output end;

(b) a continuous, porous conveyor belt within said housing, said belt having a generally horizontally disposed run extending between said input and said output ends, and being configured to be driven to convey granular material, at a desired depth thereon, from said input end of said output end;

(c) a nozzle disposed beneath said belt run and oriented to blow the gas, at a pressure greater than ambient gas in said housing, upwardly through said belt run to create a spout within the granular material to effect stirring;

(d) a plurality of feed pipes extending generally transverse to the direction of movement of said belt, each of said feed pipes disposed beneath said belt run and mounting a plurality of nozzles, each nozzle oriented to blow the gas, at a pressure greater than ambient gas in said housing, upwardly through said belt run, said feed pipes being spaced from one another axially in a direction in which said belt run conveys granular material from said input end to said output end of said housing;

(e) a manifold extending generally parallel to the direction in which said belt run conveys the granular material, said manifold mounting each of said feed pipes and providing fluid communication between said manifold and said feed pipes; and (f) means for providing gas, at a pressure greater than ambient gas in said housing, to said manifold.

3. Apparatus in accordance with claim 2 further including a plurality of staves extending downwardly into the granular material as it is conveyed through said housing, each of said staves being positioned forwardly of a location at which a spout, created by the gas discharged from one of said nozzles and passing upwardly through the granular material, occurs.

4. Apparatus for contacting granular material with heated air, comprising:

(a) a housing having an input end and an output end;

(b) a continuous, porous conveyor belt within said housing, said belt having a generally horizontally disposed run extending between said input and said output ends, and being configured to be driven to convey granular material, at a desired depth thereon, from said input end to said output end;

(c) a nozzle disposed beneath said belt run and oriented to blow heated air, at a pressure greater than ambient air in said housing, upwardly through said belt to create a spout within the granular material to effect stirring; and (d) means for heating ambient air to said housing to elevate to a temperature wherein the ambient air is free to pass through said conveyor belt and about the granular material conveyed thereby to effect heating of the granular material.

5. Apparatus in accordance with claim 4 wherein ambient air in said housing and heated air blown from said nozzle are channeled from a common source, and wherein approximately fifteen percent (15%) to twenty-five percent (25%) of heated air from said common source is directed to said nozzle, the balance being directed into said housing to function as ambient heating air.

6. Apparatus for contacting granular material with a gas, comprising:

(a) a housing having an input end and an output end;

(b) a continuous, porous conveyor belt within said housing, said belt having a generally horizontally disposed run extending between said input and said output end, and being configured to be driven to convey granular material, at a desired depth thereon, from said input end to said output end; and (c) means for generating a spout within the granular material to effect stirring, said generating means including a nozzle disposed beneath said belt run and oriented to blow the gas, at a pressure greater than ambient gas in said housing, upwardly through said belt run.

* * * * *